United States Patent [19]

Rodriguez

[11] Patent Number: 4,783,018

[45] Date of Patent: Nov. 8, 1988

[54] APPARATUS AND METHOD FOR CUTTING AND SPOOLING A WEB OF PAPER

[75] Inventor: Peter A. Rodriguez, Atlantic Beach, Fla.

[73] Assignee: Sandar Industries, Inc., Jacksonville, Fla.

[21] Appl. No.: 87,874

[22] Filed: Aug. 21, 1987

[51] Int. Cl.[4] ..... B65H 19/26; B65H 19/28

[52] U.S. Cl. ..... 242/56 R; 242/74; 242/65

[58] Field of Search ..... 242/56 R, 74, 65

[56] References Cited

U.S. PATENT DOCUMENTS

| | | | |
|---|---|---|---|
| 2,343,047 | 2/1944 | Doyle et al. | 242/56 R |
| 2,461,246 | 2/1949 | Weyenberg | 242/56 R |
| 3,599,888 | 8/1971 | Courdriet et al. | 242/74 |
| 3,765,615 | 10/1973 | Brink et al. | 242/56 R |
| 4,414,258 | 11/1983 | Corbin | 242/74 X |
| 4,659,029 | 4/1987 | Rodriguez | 242/56 R |

*Primary Examiner*—John M. Jillions

*Attorney, Agent, or Firm*—Arthur G. Yeager

[57] ABSTRACT

An apparatus and method for cutting a travelling paper web winding on a spool and a transferring web onto an empty spool by attaching a cutting tape to the empty spool, including:

a repulpable paper fiber stiff tape passing through an elongated guideway from a near end to a far end; the apparatus and method characterized by:

(1) adding adhesive to one surface of said tape before tape enters guideway; and (2) directing tape after it exits from guideway at the far end to the nip between the empty spool and the driving roll with adhesive coating contacting the empty spool.

20 Claims, 4 Drawing Sheets

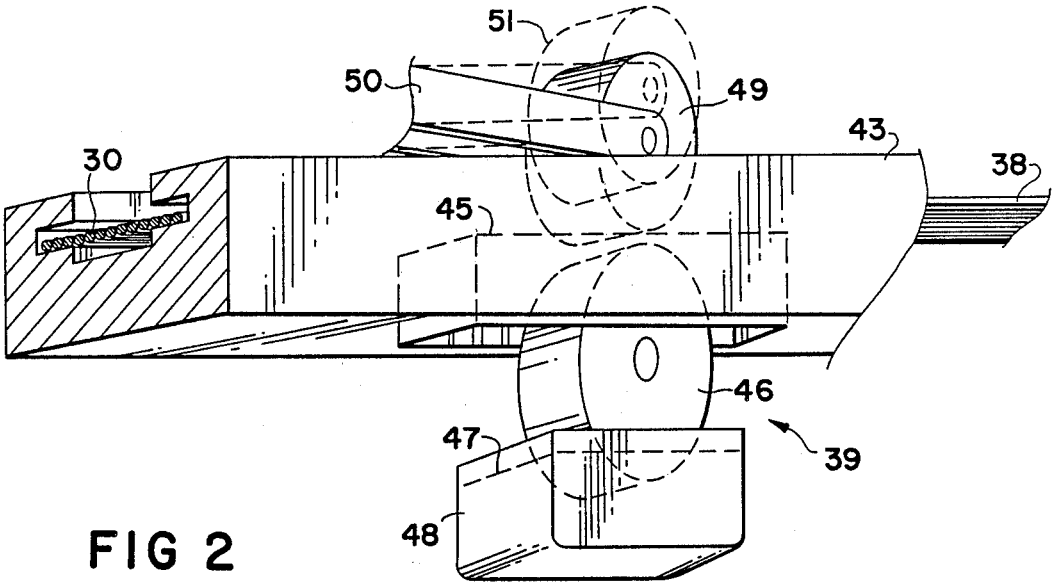
FIG 2
FIG 3
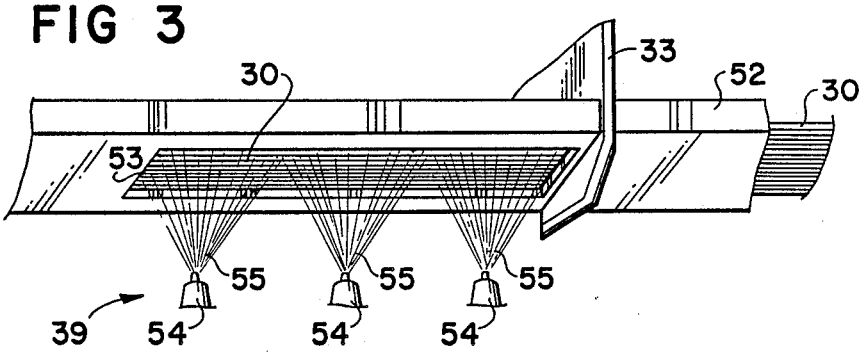
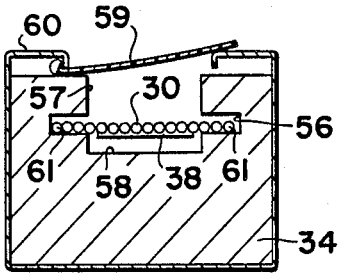
FIG 4
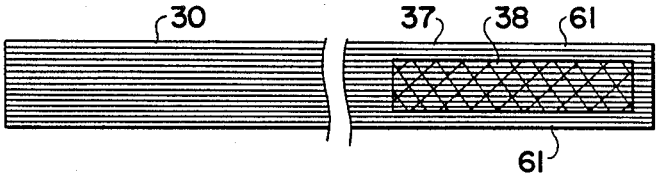
FIG 5

APPARATUS AND METHOD FOR CUTTING AND SPOOLING A WEB OF PAPER

TECHNICAL FIELD

This invention relates to an apparatus and method for cutting a travelling web of paper being wound on one spool and transferring the web to an empty spool while the web is travelling.

BACKGROUND ART

It is a general practice in the paper industry to produce a continuous sheet or web of paper which is wound onto large spools. In order to have a continuous operation it is, of course, necessary to have a system for instantaneously switching from winding the web of paper onto a full roll to an empty roll, particularly at modern speeds of paper production. In U.S. Pat. No. 2,461,246 there is shown a method of feeding a tape onto the rotating empty roll core and causing it to be spirally wrapped on that core as it stretches tight across the travelling web of paper and cuts the paper, with the cut edge being led onto the empty roll supported by the cutting tape. Subsequent improvements have dealt with methods of stringing the tape for cutting and feeding, and the use of various types of tapes, as shown for example in U.S. Pat. No. 4,414,258 where there is described a tape made of repulpable paper woven into a tape which did not interfere with the paper making process since the paper wound adjacent the roll is waste and is recycled. The most recent improvement is disclosed in my U.S. Pat. No. 4,659,029 which describes the use of a repulpable paper fiber tape in an elongated guideway to direct the tape under a travelling web of paper and direct the tape into the nip of an empty spool so as to cut the web of paper and start it rolling onto the empty spool.

It is an object of this invention to provide an improvement in feeding the tape onto the empty spool. It is another object to provide such a system that can be operated from a remote control so as to avoid any possibility of interfering with the travelling web of paper. Other objects will appear from the more detailed description which follows.

BRIEF DESCRIPTION OF THE INVENTION

This invention relates to a system for cutting with a tape, a travelling web of paper, being wound on a first spool and transferring that travelling web onto an empty spool by attaching the tape to the empty spool. The tape travels slidingly through a guideway with an elongated slot facing upwardly underneath the web and exiting from the guideway beyond the edge of the web. The improvement comprises applying an adhesive to one surface of the tape at its forward end before entering the guideway.

This invention also relates to an improved method for cutting a travelling web of paper being wound on a spool and transferring the web after cutting to an empty spool, the method including a cutting tape being fed into an elongated guideway positioned beneath and extending laterally across the web of paper, recovering the tape from the far end of the guideway and introducing it into the nip of the empty spool and the roller driving that spool to cause the tape automatically to spirally wrap around the empty spool while cutting the web of paper. The improvement comprises the steps of:

(1) applying adhesive to a portion of the cutting tape at its forward end prior to feeding the cutting tape into the guideway; and (2) receiving the cutting tape exiting the guideway and feeding the forward end into the nip with the adhesive portion contacting the empty spool.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 2 is a schematic illustration of a first embodiment for applying adhesive to the cutting tape;

FIG. 3 is a schematic illustration of a second embodiment for applying adhesive to the cutting tape;

FIG. 4 is a cross sectional view taken at 4—4 of FIG. 1;

FIG. 5 is a top plan view of the cutting tape of the invention;

DETAILED DESCRIPTION AND BEST MODE OF THE INVENTION

Figure 1:
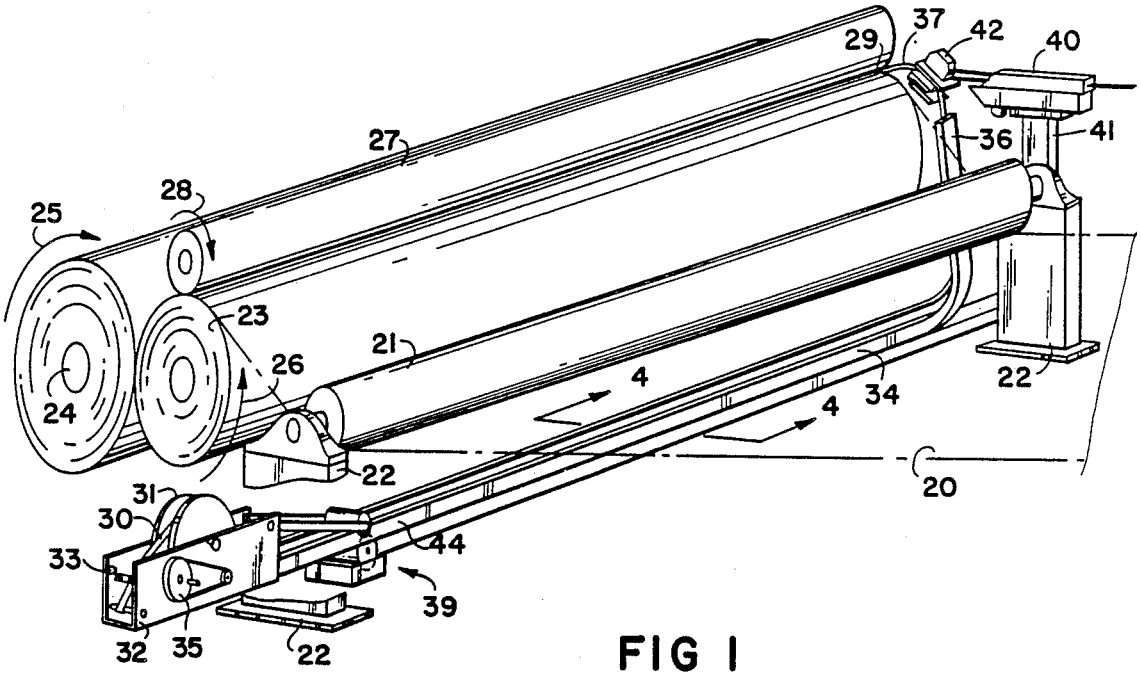
FIG. 1 is a perspective view of the system of rollers employed in the paper industry to wind the paper web onto rolls, and the present apparatus used to transfer the leading edge of the web to an empty spool in accord with this invention.

The general features of this invention are best seen and understood by reference to FIG. 1 which shows the general type of equipment employed in a paper manufacturing plant to wind up the manufactured paper on rolls for storage and use elsewhere. A continuous web of paper 20 travels at a relatively rapid rate of speed to a combination of spools upon which the paper is rolled, Paper web 20 advances toward tension roll 21 mounted in journals on supports 22, leading web 20 over driving roll 23 and winding about spool 24 turning in the direction of arrow 25. Driving roll 23 turns in the direction of arrow 26 and is pressed against the paper roll on spool 24 causing it to rotate in the indicated direction. When spool 24 has been filled to the desired capacity with paper from web 20, it is necessary to cut web 20 laterally, transfer the cut edge to an empty spool 27, and start the web winding on that spool in the direction of arrow 28 to eventually produce another filled spool, such as spool 24. Empty spool 27 is positioned vertically above the location shown in FIG. 1 until it is ready to accept paper from web 20 and begin winding it up. Spool 27, which may or may not be separately rotated as known in the art, is lowered until it contacts driving roll 23 and rotates with it, as shown in FIG. 1. The cut edge of web 20 is then pushed into the nip 29 between empty spool 27 and driving roll 23, causing it to be wound onto spool 27 and to cause a transfer of the paper web thereto.

The apparatus of this invention generally includes a means for supplying a cutting tape 30 to the far edge of empty spool 27 and for causing that tape to wrap around spool 27 in a spiral fashion so as to cut web 20 and cause the cut edge to be introduced onto spool 27 and be wrapped about spool 27. A supply of cutting tape 30 is preferably maintained on a removable drum 31 in a housing 32 which also serves to support a cutting means 33 which, at the appropriate time, cuts tape 30 from the large supply on drum 31. It will be appreciated that only a definite length of tape, longer than the width of web 20, is needed to cut across web 20 laterally and to cause the cut edge to begin wrapping itself upon empty spool 27, and thus at the appropriate place tape 30 is cut and further tape is not needed until spool 27 becomes filled with paper and must be replaced by another empty spool. Tape 30 passes through cutting means 33, adhesive application means 39 (shown outside of housing 32 for illustration purposes only and preferably located within the confines of housing 32, as would be understood by persons having ordinary skill in the art) and into a guideway 34 propelled by a driving means, e.g., hand crank 35 to cause the free end of tape 30 to move completely across the width of web 20 underneath that web in guideway 34 until it reaches the far end 36 where the free end 37 of tape 30 is made available to be inserted into nip 29 between spool 27 and driving roll 23. As seen in FIG. 5, an adhesive strip 38 is applied to forward end 37 of tape 30 so that when it is introduced into nip 29 it will adhere to the surface of empty spool 27. In a preferred embodiment a mechanical arm 40 is mounted on a stand 41 and has a hand 42 which grips tape 30, and on command extends hand 42 toward nip 29 until tape 30 is caught in nip 29 and is adhered to the surface of empty spool 27. A frictional resistance is then applied to the tape 30 adjacent near end 44 e.g., the frictional resistance produced when tape 30 is dislodged from guideway 34, causing the tape 30 to spiral across the length of empty spool 27 and cut through web 20 as it does so and causes a transference of web 20 onto empty spool 27.

FIG. 2 is a schematic illustration of a first embodiment of the adhesive applicator 39 of FIG. 1. Cutting tape 30 is in a channel guide 43 anywhere between cutter 33 and preferably the near end 44 of the main elongated guideway 34. An opening 45 in channel 43 exposes the central portion of the lower surface of tape 30. Roller 46 is suitably rotatably mounted so that its outer surface is in opening 45 with its outer portions also immersed in a pool of liquid adhesive 47 in reservoir 48. Above tape 30 in vertical alignment with opening 45 is a pressure roller 49 mounted on arms 50 which are selectively movable from a retracted remote upward position 51 (shown in broken lines) to a downward pressure position as shown in solid lines in FIG. 2. The pressure position presses tape 30 downwardly to contact roller 46 causing adhesive 47 to be coated onto the bottom surface of tape 30 for a selected length and width, preferably an adhesive strip, such as illustrated by 38 in FIG. 5. Strip 38 is spaced inwardly of the side edges of the tape 30 so that the adhesive will not contact the guideways through which it passes, as hereinafter more fully described.

In FIG. 3 there is a second embodiment of the adhesive applicator. Tape 30 passes in a channel guide 52 having an opening 53 in the lower side to expose tape 30 to the action of spray nozzles 54 which spray adhesive 55 onto tape 30. In one version of this system, cutter 33 would be located immediately forward of opening 53 so that when the preceding length of tape 30 is cut, the adhesive 55 may be applied to form a strip of adhesive coating immediately behind the cut and thereby will form the forward end 37 (see FIG. 1) for the next length of tape 30 to be used in cutting the web 30 and starting it to roll onto empty spool 37. Another version would be to advance the tape 30 after cutting to a position where the spray 55 is applied prior to advancing the tape through main elongated guideway 34.

Figure 6:
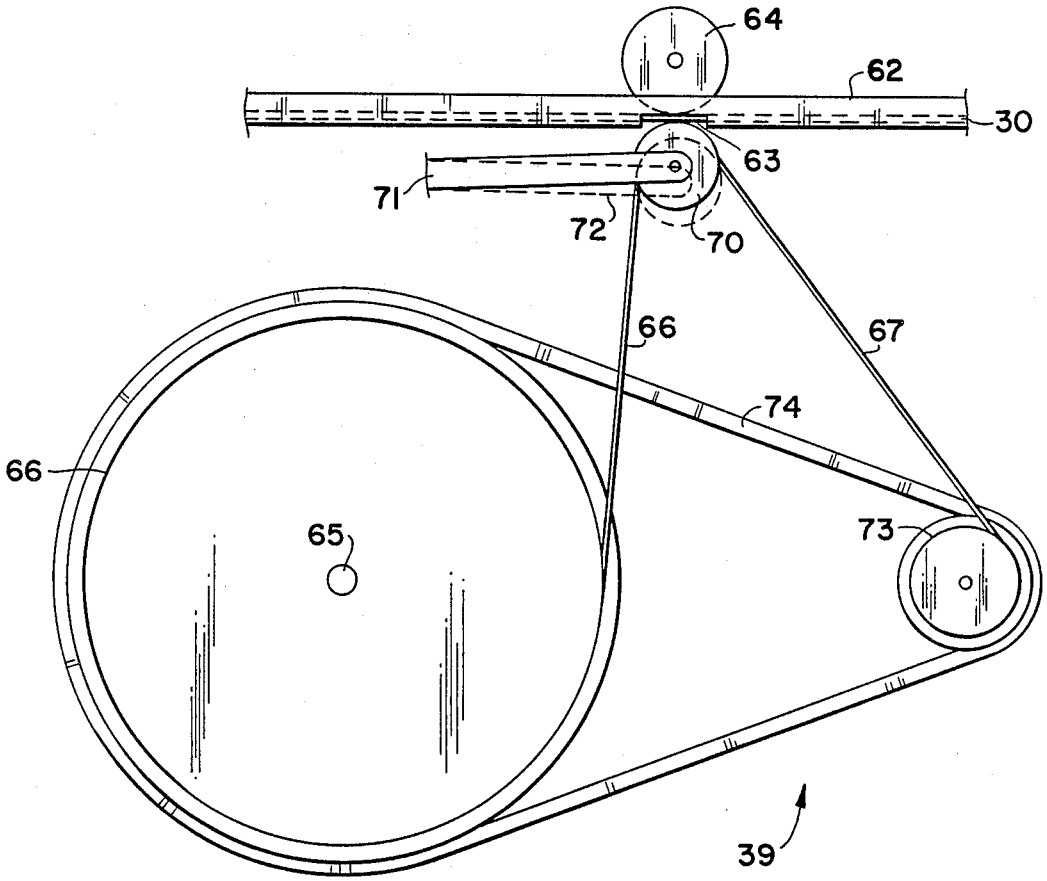
FIG. 6 is a schematic illustration of a third embodiment for applying adhesive to the cutting tape.

In FIG. 4 there is shown a preferred design of guideway 34 for use with adhesive applicators which apply the adhesive to the underneath surface of tape 30 as in FIGS. 2, 3, and 6. The purpose of applying the adhesive to the lower surface of tape 30 is that when using certain designs of mechanical arm 40 with a telescopically extensible hand 42 it is easier to present tape 30 to hand 42 with the adhesive side facing hand 42 so it can be fed into nip 29 with the adhesive side facing upward to contact empty spool 27. Other types of mechanical arms with other movements for hand 42 may be used possibly with the adhesive side upwards in guideway 34. More importantly in paper making, the attendant side of the machine is the near side where housing 32 and spool 31 of tape 30 is located, with the far side having the belts and pulleys to drive the rolls, etc. Refilling the spool 31 with tape, adding adhesive to reservoir 48 and the like from the near side enhances the efficiencies of the disclosed system and method and greatly increases the safety in use. Guideway 34 has an internal channel 56 with a rectangular cross section designed to permit tape 30 to slide lengthwise therein. An elongated slot 57 is parallel to channel 55 and communicates between channel 55 and the outside atmosphere. When tape 30 has been caught in nip 29 and starts to wind on empty spool 27 tape 30 will be pulled laterally out of channel 55 through slot 56, and thereby produces the frictional resistance necessary to cause tape 30 to wind spirally around spool 27 cutting web 20 and starting the cut edge to wrap onto spool 27. In this invention when the bottom surface of tape 30 is coated with adhesive 38 it is necessary to provide an undercut recess 58 which is as wide as the adhesive coating 38. In this way tape 30 can slide through guideway 34 in channel 55 without having the adhesive coating adhere to any guideway 34. An added feature is the provision of a resilient flap cover 59 held in place by spring clip 60. Flap cover 59 keeps dirt out of channel 55 and yet will flex upwardly and not inhibit the removal of tape 30 through slot 57 when that occurs during cutting of the paper web. Also, flap cover 59 provides protection from debris and moisture of the paper tape 30 during its travel through guideway 34.

FIG. 5 shows tape 30 with a coating 38 where adhesive has been applied at forward end 37. It may be seen that the lateral edges 61 are not covered with adhesive and thereby are available to support tape 30 as it slides in channel 56 as clearly shown in FIG. 4.

Figure 7:
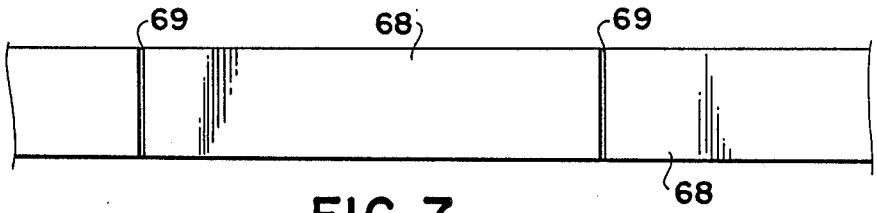
FIG. 7 is a top plan view of double-sided adhesive tape used in this invention.
Figure 8:
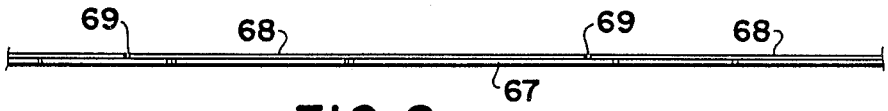
FIG. 8 is a side elevational view of the tape of FIG. 7.

A third embodiment of a means for applying adhesive to tape 30 is shown in FIGS. 6–8. Tape 30 is supported in a channel 62 having an opening 63 to expose the underneath side of tape 30. Hold down roller 64 maintains a slight pressure downward on tape 30 above opening 63. Supply spindle 65 carries a roll of double-sided pressure sensitive tape 66 which includes a continuous release binder 67 and a plurality of lengths of pressure sensitive adhesive preferably separated from each successive length 68 by a short space 69 where no adhesive is on release binder 67. Tape 66 is fed from roll 65 over pressure roller 70 rotatably mounted on arms 71 which can move from the downward inoperative position 72 (in broken lines) to the upward operative position in solid lines. A tape 66 passes between roller 70 and tape 30, the adhesive section 68 is pressed onto tape 30 while release tape 67 is rolled onto spool 73. When a section 68 of adhesive is applied to tape 30, arms 71 move to the inoperative position 72 and roll 65 is stopped until needed again. Roll 65 is shown as driving spool 73 by belt 74. It is to be understood that the double sided adhesive may simply be perforated, rather than spaced, in which event the trailing adhesive length 68 will be parted from the adhesive length 68 applied to tape 30 due to advancement of tape 30 after roller 70 moves to its inoperative position 72.

Figure 9:
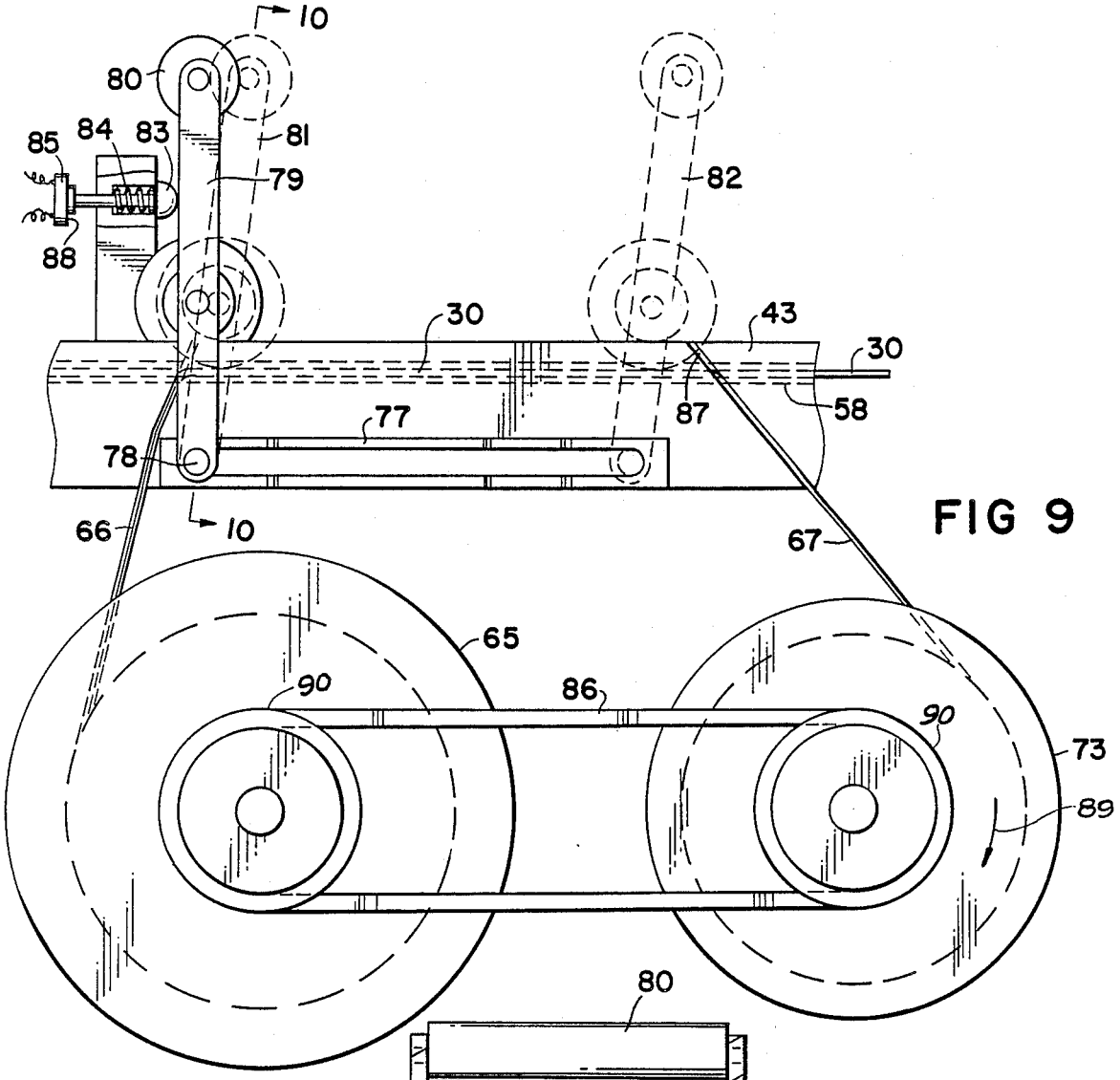
FIG. 9 is a schematic illustration of a fourth embodiment for applying adhesive to the cutting tape.
Figure 10:
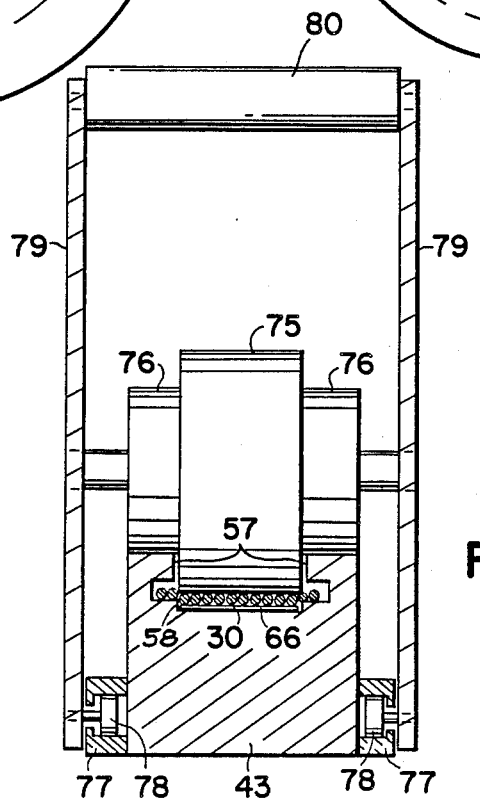
FIG. 10 is a cross section taken at 10—10 of FIG. 9.

In FIGS. 9–10 there is shown a fourth embodiment for applying adhesive to tape 30 employing a double-sided pressure sensitive tape 66 as shown in FIGS. 7 and 8. A pressure roller 75 is mounted to apply pressure to tape 30 while in guideway 43 lying above a length of double-sided adhesive tape 66 also in guideway 43. After release tape 67 is peeled away, tape 30 is left with a specific portion of its bottom side coated with adhesive as at 38 in FIG. 5 which is then available to be forwarded to the tip 29 of rolls 23 and 27 to cut web 20 and start spooling the web 20 on roll 27. In this embodiment double-sided adhesive tape 66 is fed from spool 65 into the undercut recess 58 at the bottom of guideway 43 to a forward location 87, with release tape 67 between recess 58 and the upward facing strip of adhesive 68 (see FIGS. 7–8). Tape 30 is then advanced in internal channel 56 over the top of tape 66 in recess 58 and stopped with its forward cut end at 87. Handle 80 is then pushed forward to position 81 where pressure roller 75 is pressing downward on tape 30 over the width of recess 58, and the handle 80 pushed forward to position 82. By reason of the pivoting about rollers 78 in rails 77 this movement causes roller 75 to press down tape 30 into recess 58 to contact adhesive portion 68 of double-sided tape 66 and cause adhesive tape 66 to stick to tape 30. Rolls 76 are sized to eventually touch the top of guideway 43 and prevent roll 75 from applying more pressure on tape 30 than that necessary to pick up adhesive tape 66. Handle 80 is then pulled back to its original position and released in its upright position (solid lines) which allows tape 30 to return to its original undeformed flat condition not pressed into recess 58. In returning to its original position one of supports 79 pushes on head 83 causing contact pad 88 to touch contact plate 85 providing electric power to a means (not shown) to turn spool 73 in the direction of arrow 89. This causes release tape 67 to be stripped from the adhesive stuck to tape 30, and at the same time, to advance the next section 68 of two-sided adhesive tape 66 along recess 58 to forward position 87. The means of turning spools 65 and 73 simultaneously is shown as a V-belt 86 operating in pulleys 90. Obviously other driving means such as gears, chain-and-sprocket, and the like can be employed for the same purpose. This finishes the cycle and prepares tape 30 for advancement to nip 29 to cut web 20 and start rolling it onto spool 27, while a new section of tape 30 is advanced to point 87 to have an adhesive spot applied to it.

Several embodiments have been shown for applying a strip of adhesive to cutting tape 30. It is to be understood that other means may be equally operative and are intended to be included in this invention. The means shown in FIGS. 2, 3, 6, 9, and 10 are preferred embodiments, but other means, mechanical, manual, or otherwise are operative. It is only necessary to this invention that the adhesive strip be applied before the tape reaches near end 44 of guideway 34. This is a safety measure to permit all operations to be controlled by an operator located adjacent near end 44 without ever needing to be present at far end 36 of guideway 34.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what is desired to be secured by Letters Patents is:

1. In a system for cutting with a tape a travelling web of paper being wound on a first spool and transferring that travelling web onto an empty spool by attaching said cutting tape to said empty spool, said cutting tape travelling via a guideway with an elongated slot facing upwardly underneath said web and exiting from said guideway beyond the edge of the web; the improvement which comprises an adhesive without any covering thereon applied to one surface of said tape at its forward end before entering said guideway.

2. The system of claim 1 wherein said adhesive covers only a central lengthwise surface portion of said cutting tape, leaving non-adhesive lengthwise edge portions.

3. The system of claim 1 wherein said adhesive is applied to the surface of said cutting tape which is remote from said slot.

4. The system of claim 1 further comprising a double-sided adhesive binder for applying said adhesive to said tape.

5. The system of claim 1 wherein said adhesive is a spray adhesive applied onto said cutting tape before entering said guideway.

6. The system of claim 1 wherein said adhesive is a liquid, further comprising a roller means for applying said liquid adhesive to said tape.

7. The system of claim 2 wherein said cutting tape enters said guideway with said surface portion carrying said adhesive away from said slot, said guideway having an elongated recess opposite to said slot, said recess being adapted to support said cutting tape on said lengthwise edge portions with said central lengthwise portion spaced from the lower wall defining said guideway.

8. The system of claim 7 which additionally comprises a remotely controlled mechanical arm which is adapted to grip said cutting tape behind said adhesive coated portion at said forward end as said cutting tape exits from said guideway and feeds said forward end into contact with said empty spool.

9. The system of claim 4 which additionally comprises a supply roll of double-sided pressure sensitive adhesive tape, said release binder having a layer of adhesive coated thereon, a spindle for mounting said roll, said roll being adapted to selectively dispense lengths of said adhesive tape therefrom; a channel guide for conducting said cutting tape in a direction parallel to said adhesive tape, means for introducing said adhesive tape below said cutting tape and aligned lengthwise therewith; means for pressing said adhesive tape against said cutting tape; and means for pulling said release binder away from said adhesive tape, leaving said adhesive as a coating on said cutting tape.

10. The system of claim 9 wherein said means for introducing adhesive tape comprises a channel having an opening therein to expose a central portion of said cutting tape in said channel; said means for pressing comprises a pair of roller adjacent said opening and generally vertically aligned above and below said cutting tape, one of said rollers being selectively movable as a pressure roller toward and away from the other said roller, a first said roller carrying said adhesive tape to deposit said double sided adhesive onto said cutting tape with said rollers pressing said adhesive into intimate contact with said cutting tape; and said means for pulling said release binder away comprises a wind-up spool to wind up said release binder after being stripped from said adhesive after being deposited onto said cutting tape.

11. The system of claim 6 which additionally comprises a channel guide for conducting said cutting tape through an adhesive application station, said station including a supply of liquid adhesive in a container, applicator roller means adapted to contact said supply of liquid adhesive and to transfer said liquid adhesive to a surface of said cutting tape in said channel guide, and another roller means positioned on the opposite side of said cutting tape from said applicator roller means, one of said roller means being selectively urged toward the other said roller means to intimately transfer adhesive from said applicator roller means to said tape.

12. The system of claim 9 which additionally comprises said guideway having an elongated recess opposite to said slot, said recess adapted to support said cutting tape on lengthwise edge portions with a central lengthwise portion spaced from the lower wall of said guideway; said means for introducing adhesive tape comprising a passageway for introducing said adhesive tape through said bottom wall of said guideway into said recess; said means for pressing comprising a roller placed above said cutting tape and adapted to optionally press said cutting tape downward along said central lengthwise portion against said adhesive tape in said recess; and said means for pulling said release binder away comprises a wind-up spool to wind up said release binder as it is being stripped from said adhesive tape after being pressed onto said cutting tape.

13. An improved method for cutting a travelling web of paper being wound on a spool and transferring the web after cutting to an empty spool, the method including feeding a cutting tape into an elongated guideway positioned beneath and extending laterally across the web of paper, recovering the tape from the far end of the guideway and introducing it into the nip of the empty spool and the roller driving that spool to cause the tape automatically to spirally wrap around the empty spool while cutting the web of paper; wherein the improvement comprises the steps of:

(1) applying adhesive without any-covering thereon to a portion of the cutting tape at its forward end prior to feeding the cutting tape into the guideway; and (2) receiving the cutting tape exiting the guideway and feeding the forward end into the nip with the adhesive portion contacting the empty spool.

14. The method of claim 13 wherein the adhesive is applied to the cutting tape by contacting the cutting tape with a pressure sensitive adhesive coated onto a release binder, and stripping away the release binder.

15. The method of claim 13 wherein the adhesive is applied to the cutting tape by spraying adhesive onto the cutting tape.

16. The method of claim 13 wherein the adhesive is applied to the cutting tape by passing the cutting tape into contact with an applicator roller which receives a coating of liquid adhesive from a supply thereof.

17. The method of claim 13 wherein the guideway includes an elongated guideway substantially the width of the cutting tape with an elongated slot above the guideway adapted to permit the cutting tape to be pulled out laterally from the guideway, and an elongated undercut recess below the guideway narrower than the guideway and centered on the guideway, the undercut recess having a width greater than the width of the adhesive portion on the cutting tape.

18. The method of claim 13 which additionally comprises gripping the cutting tape as it exits from the guideway by means of a remotely controlled mechanical arm, and directing that arm to feed the far end of the cutting tape having an adhesive coated portion into the nip.

19. The method of claim 13 which additionally comprises gripping the cutting tape as it exits from the guideway, and selectively feeding the far end of the cutting tape having adhesive coated portion into the nip.

20. The method of claim 18 wherein said selectively feeding is automatically accomplished upon lowering the empty spool onto the roller driving the empty spool.

* * * * *